United States Patent [19]

Evertz et al.

[11] 4,298,180

[45] Nov. 3, 1981

[54] METHOD OF REPAIRING STEELWORKS INGOT MOULDS AND CAST-IRON STEELWORKS INGOT MOULD

[75] Inventors: Egon Evertz, Vorlander Strasse 23, 5650 Solingen, Fed. Rep. of Germany; R. Seybold, Solingen, Fed. Rep. of Germany

[73] Assignee: Egon Evertz, Solingen, Fed. Rep. of Germany

[21] Appl. No.: 54,873

[22] Filed: Jul. 5, 1979

[30] Foreign Application Priority Data

Jul. 5, 1978 [DE] Fed. Rep. of Germany ..... 2829448

[51] Int. Cl.[3] ..... B22D 7/06; B23P 6/04

[52] U.S. Cl. ..... 249/135; 29/402.15; 29/402.16; 164/1; 249/174

[58] Field of Search ..... 249/174, 135; 29/402.09, 402.14, 402.15, 402.16, 530, 402.11, 402.12, 402.13, 402.17; 164/92, 1; 52/514; 114/227

[56] References Cited

U.S. PATENT DOCUMENTS

| | | | |
|---|---|---|---|
| 3,464,103 | 9/1969 | Harris | 29/402.12 X |
| 3,808,667 | 5/1974 | Evertz et al. | 29/402.14 |
| 3,955,265 | 5/1976 | Evertz et al. | 29/402.15 |
| 4,015,814 | 4/1977 | Fowles | 249/174 |

FOREIGN PATENT DOCUMENTS

| | | | |
|---|---|---|---|
| 1938713 | 2/1971 | Fed. Rep. of Germany . | |
| 2630253 | 1/1977 | Fed. Rep. of Germany | 29/402.14 |
| 1369342 | 7/1964 | France | 29/402.16 |
| 47-19503 | 6/1972 | Japan | 249/174 |
| 764622 | 12/1956 | United Kingdom | 29/402.12 |
| 1431896 | 4/1976 | United Kingdom | 249/174 |
| 366053 | 3/1973 | U.S.S.R. | 249/174 |

*Primary Examiner*—Robert D. Baldwin
*Assistant Examiner*—J. Reed Batten, Jr.
*Attorney, Agent, or Firm*—Holman & Stern

[57] ABSTRACT

A method of repairing an ingot mould for a steelworks which forms cracks, the method comprising applying a patch plate at both sides of the crack, a series of patch plates being provided in succession in the direction of the length of the crack, reinforcement strips curved to match the curvature of the mould wall being provided on the patch plates and being adjusted to positions transversely of the length of the crack and then fixed on the plates.

13 Claims, 1 Drawing Figure

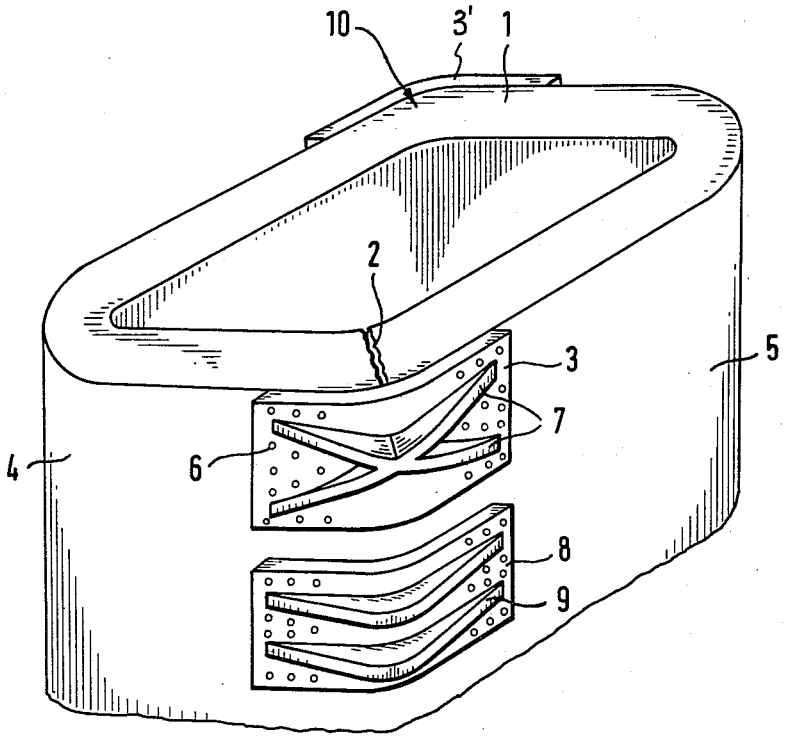
10
3'
1
2
3
5
7
4
6
8
9

METHOD OF REPAIRING STEELWORKS INGOT MOULDS AND CAST-IRON STEELWORKS INGOT MOULD

BRIEF SUMMARY OF THE INVENTION

This invention relates to a method of repairing steelworks ingot moulds made of cast iron, particularly with spherolithic graphitization, which form continuous cracks and are provided, in the region of such a crack with an externally applied patching plate fixed to the mould walls on both sides of the crack.

Such a method is known from US-PS No. 33 60 845, where the cracks which have formed are covered by patching plates which are welded to the mould walls on both sides of the crack. It is here also possible to add more iron or steel of a suitable composition to the welding melt. Alternatively the ingot moulds may be provided from the outset with a steel 'corset' which maintains the mould under preapplied tension and thus prevents cracking.

Where cracks have already appeared, on the other hand, it is known from GE-OS No. 19 38 713 for a patching plate to be heated only in that region thereof which lies between its fixing means to the mould walls and to be permanently bonded to the mould walls after such heat application so that the subsequent cooling contraction of the patching plate enables a previously formed crack to be closed up or drawn tightly together once more. Whilst this method may often be highly successful it has, nevertheless, certain limitations: for, on the one hand, where very strong contraction forces are needed, the patching plates must be very thick-walled with correspondingly heavy fixing bolts between patching plates and mould walls. The operations of fitting and fixing such heavy gauge patching plates are expensive. On the other hand, ingot moulds made of cast iron with spherolithic graphite separation tend to suffer from considerably more severe cracking damage than moulds made, for example, of hematite or steel pig. Thermal expansion is substantially greater for cast iron with spherolithic graphitization than for hematite or steel pig so that greater tensions will be created on heat application which may give rise to correspondingly more severe cracking. Nevertheless cast iron with spherolithic graphite-separation is a preferred material for steel works ingot moulds because it has a lower thermal conductivity and superior thermal capacity, or specific heat, than hematite or steel pig, both of which properties are an advantage for fast cooling of the steel ingot cast in the mould and later heat retention of the mould.

The parts or regions of the ingot mould which are particularly susceptible to cracking are, on the one hand, the edge regions and, on the other any radiussed or curved wall regions thereof. In such moulds the initial longitudinal cracks are liable to spread over the full length of the mould. At this point, if not before, the strong tensions involved will set up shift or dislocation forces in the vertical as well as in the horizontal direction so that cracks of this kind can no longer be closed up or drawn tight by the above described conventional methods and means and permanent gaps must inevitably result. Ultimately this is due to the fact that the ingot mould simply cannot be deformed to the degree required to achieve a neat and positive closing up of a crack of this kind.

Seen against this background the present invention aims to provide a method of the kind specified which is designed to give a substantially longer service life to steelworks ingot moulds.

This aim is realised, according to the present invention, by virtue of the fact that on appearance of a first longitudinal crack in the mould wall a series of patching plates is arranged in succession in the direction of said longitudinal crack and fixed to the mould walls on both sides of said crack and that then reinforcing strips radiussed to match the curvature of the mould walls are adjusted on said patching plates substantially transversely of the length of the crack and subsequently fixed thereto. Both, the patching plates and the reinforcing or backing strips consist of steel.

In this way it is possible, instead of using the previously required very heavy gauge patching plates, to work with comparatively thin patching plates, a plate thickness of 20 mm being found quite adequate for the purpose. It will be readily appreciated that this makes the adjustment of the patching plates and their fixation in the crack region considerably easier. Above all, there are now no problems at all in respect to fixation of the patching plates outside the actual crack zone in the expected continuation zone of the crack. However, these thin patching plates alone could not oppose sufficiently strong resistance to crack-expansion of the kind hereinbefore described; but they can be made sufficiently resistant and strong in respect of bending and tilting forces by application of the second stage or provision of the inventive method, namely reinforcement of the patching plates by means of reinforcing or bracing strips. The patching plates which are thus strengthened by bracing strips or reinforcing ribs are effectively capable of taking up not only the tensions and strains which occur normally in steelworks ingot moulds but also the bending- and/or tilting forces which occur specifically with steel works ingot moulds made of cast iron with spherolithic graphite separation, and over and above this, it is possible, thanks to the present invention, to control and contain the forces which arise in connection with completely through-extending cracks in ingot moulds of all types of material.

The patching plates may be positively material-bonded to the mould walls by welding, as known, for example, from the earlier cited US-PS No. 33,60,845. Highly effective connections may also be obtained by means of bolts, the number and relative spacing of which would however be greater than required for simply fixing patching plates to moulds made of hematite or steel pig. This is due to the fact that in cast iron with spherolithic graphitization, owing to the earlier mentioned inferior thermal conductivity as compared with steel and the higher thermal capacity or specific heat as compared with the remaining cast iron, very considerable forces are created which tend to shift or dislocate the mould wall in the longitudinal direction as well as in a direction perpendicular to the first original crack. Such bolting patterns are also indicated for other mould materials when dealing with cracks which extend almost or fully through the mould wall. For preference the said reinforcing or bracing ribs are also material-bonded to the patching plates by welding.

For optimum design efficiency of the reinforcing ribs or bracing strips and also in the interests of a smooth and unobtrusive application and service of the repaired moulds it is advisable to make the configuration of said ribs or strips similar to the profile of a bilaterally supported load bearing girder of constant strength along its length and to fix them in a substantially vertically projecting position to the patching plates. If provided with one such reinforcing rib or bracing strip only the patching plate together with said strip will have a T-profile in cross section whilst viewed longitudinally the strip tapers out towards a thinner end region and grows thicker towards the middle.

Advantageously some of the patching plates may be provided on their outside with several reinforcing ribs or bracing strips. In this fashion it is possible to avoid unduly far projecting ribs or strips and also to make them of thinner material.

In further development of this invention it is an advantage to provide several reinforcing ribs or strips on the outsides of the patching plates which extend either parallel with eachother or cross one another scissor-fashionwise. Especially in this latter form they are particularly well suited to meet the loads and stresses arising from dislocation tendencies in the crack region.

The dimensions and relative spacing of patching plates in a multiple, successional arrangement of such plates are normally governed by the relation of a plate width of approximately 500 mm and a relative spacing distance of approximately 20 mm between plates.

For constructional design and operational reasons as earlier mentioned it is advisable to arrange for the height of the ribs or strips to increase maximally to four times the thickness of the plate material.

In a particularly advantageous form of applying this invention, when the first longitudinal cracks appear on one side of the ingot mould the diametrally opposite side of the mould will be likewise provided with patching plates and associated bracing strips or reinforcing ribs. This repair method is based on the experience that generally, once a crack has appeared, especially in the region of one of the edges of the mould, and following some further spreading or expansion of such a crack, another crack will appear in the opposite edge, and accordingly both of the relatively opposite edge regions of the mould are treated in accordance with this invention right from the very start of crack formation even through one of said sides may as yet reveal no traces of cracking.

In further development of the invention, and based on the same principle of the proposed reduction of splits or cracks, a steelworks ingot mould of cast iron, and in particular with spherolithic graphitization, is made in such a way as to be reinforced from the outset by external bracing plates applied in those regions of the mould which are particularly susceptible to longitudinal cracking, notably along the edges of the mould, said external bracing plates in their turn being provided with reinforcing ribs or strips with a constant strength girder-type profile. In other words, these external bracing plates are designed in precisely the same manner as the previously described patching plates and provided with correspondingly shaped and arranged reinforcing ribs or bracing strips. A mould of this type will obviously be considerably more durable so that subsequent repair and maintenance work for an ingot mould of this type may often be confined to the inside walls of the mould which are liable to be affected by shallower heat cracks.

In further illustration of the invention reference is made to the accompanying drawing.

BRIEF DESCRIPTION OF THE DRAWING

The single FIGURE of the drawings show a perspective elevation view of the upper part of an ingot mould utilizing the invention.

DETAILED DESCRIPTION

For greater simplicity the drawing only shows the upper part of the ingot mould which is represented isometrically in a slanting top view. The mould wall 1 shows the crack 2 issuing from the top edge and cutting right through the wall 1. Immediately on first appearance of this crack the patching plate 3 was secured by means of bolts 6 to the walls 4 and 5 of the mould on either side of the crack 2. Then the sicle- or crescent-shaped reinforcing ribs or bracing strips 7 were prepared to match the curvature of the patching plate 3 and welded on said patching plate 3. Since the oppositely directed dislocation forces of the crack are particularly high in the upper part of the crack both in the vertical and in the horizontal direction, the reinforcing ribs or bracing strips 7 were applied in a scissor-fashionwise cross-over-pattern to the upper patching plate 3.

By contrast it will be seen that the crack has not yet propagated into the region which is covered by the lower patching plate 8 and for this reason only relatively parallel bracing ribs 9 were have provided.

The diametrally opposite mould edge 10 was treated in the same way, but only with relatively parallel bracing strips 9 on the patching plates. See the top of patching plate 3' in the drawing. In each case the patching plates with their reinforcements were applied over the full length of the mould.

Whilst in the foregoing we have described the application of the patching plates with their reinforcing parts to a mould of such sectional configuration that the patching plates and their bracing strips would be of convex, or bi-convex form, as viewed in plan, it will be appreciated that they are also applicable with equal advantage to ingot moulds of a different cross sectional form, e.g. with fluted walls or where the walls are indrawn between longitudinal edges of the mould. In that event the patching plates and their bracing ribs or strips would be of concave or bi-concave form.

We claim:

1. A method of repairing steelworks ingot moulds made of cast iron and having corners in which continuous cracks form, comprising, on appearance of a first longitudinal crack in a wall at a corner of the mould, the steps of securing to the exterior of the mould a series of patching plates in succession in the direction of said longitudinal crack, the plates extending on opposite sides of the crack, likewise securing to the exterior of the mould at the corner diametrically opposite said corner having the crack therein, a second series of patching plates diametrically opposite to the first mentioned patching plates, providing reinforcing ribs which are shaped to match the contour of the mould wall at the corner adjacent said crack and said diametrically opposite corner, arranging said reinforcing ribs on said first mentioned patching plates substantially transversely to the length of the crack and likewise on said second series of patching plates diametrically opposite said first mentioned patching plates, and subsequently securing said reinforcing ribs to said patching plates.

2. A method as claimed in claim 1, wherein the step of securing the reinforcing ribs to the patching plates comprises positively material-bonding said ribs to the patching plates by welding.

3. A method as claimed in claim 1 wherein the step of securing the patching plates to the mould comprises positively material-bonding said plates to the mould by welding.

4. A method as claimed in claim 1 wherein the step of arranging said reinforcing ribs on the patching plates comprises arranging a plurality of reinforcing ribs on each said plate.

5. A method as claimed in claim 1 wherein each patching plate is provided with a plurality of reinforcing ribs arranged in a scissor-type cross-over pattern.

6. A method as claimed in claim 1 wherein the dimensions and spacing of the patching plates are basically determined by a standard plate width of approximately 500 mm and a distance between plates of approximately 20 mm.

7. A method as claimed in claim 1 wherein the height of each of the reinforcing ribs rises maximally to four times the thickness of the patching plate.

8. A method as claimed in claim 1, wherein said ingot moulds are made of nodular cast iron.

9. A method as claimed in claim 1, including the step of arranging each reinforcing rib to project substantially perpendicularly to the patching plate to which it is secured, the height of each reinforcing rib being greatest at its centre and decreasing in a tapering manner to its ends.

10. In a steelworks ingot mould of steel-reinforced cast iron having corners and which is reinforced by externally applied patching plates in a corner region having a longitudinal crack therein the improvement comprising a second series of patching plates likewise externally applied to the corner region diametrically opposite the first mentioned corner region and diametrically opposite to the first mentioned plates, externally applied reinforcing ribs on the first mentioned plates disposed substantially transversely to the length of the crack and likewise said second series of plates diametrically opposite to said ribs on the first mentioned plates.

11. An ingot mould as claimed in claim 10, wherein the reinforcing ribs are arranged in a scissor-type cross-over pattern.

12. An ingot mould as claimed in claim 10, wherein the height of each reinforcing rib is greatest at its centre and decreases in a tapering manner to its ends.

13. An ingot mould as claimed in claim 10, wherein said mould is made of nodular cast iron.

* * * * *